US011326314B2

(12) United States Patent
Bligh et al.

(10) Patent No.: US 11,326,314 B2
(45) Date of Patent: May 10, 2022

(54) DEFLECTOR BRACKET AND CABLE ANCHOR FOR GUARDRAIL TERMINAL

(71) Applicant: The Texas A&M University System, College Station, TX (US)

(72) Inventors: Roger P. Bligh, College Station, TX (US); D. Lance Bullard, Jr., College Station, TX (US)

(73) Assignee: THE TEXAS A&M UNIVERSITY SYSTEM, College Station, TX (US)

( * ) Notice: Subject to any disclaimer, the term of this patent is extended or adjusted under 35 U.S.C. 154(b) by 226 days.

(21) Appl. No.: 16/654,526

(22) Filed: Oct. 16, 2019

(65) Prior Publication Data

US 2020/0115865 A1 Apr. 16, 2020

Related U.S. Application Data

(60) Provisional application No. 62/746,352, filed on Oct. 16, 2018.

(51) Int. Cl.
*E01F 15/04* (2006.01)
*E01F 15/14* (2006.01)

(52) U.S. Cl.
CPC ..... *E01F 15/143* (2013.01); *E01F 15/0461* (2013.01); *E01F 15/146* (2013.01)

(58) Field of Classification Search
CPC . E01F 15/0423; E01F 15/043; E01F 15/0461; E01F 15/143; E01F 15/146
See application file for complete search history.

(56) References Cited

U.S. PATENT DOCUMENTS 5,069,576 A * 12/1991 Pomero ..... E01F 15/0423 404/6
5,407,298 A 4/1995 Sicking et al.
5,503,495 A 4/1996 Mak et al.
5,547,309 A 8/1996 Mak et al.
5,775,675 A * 7/1998 Sicking ..... E01F 15/0476 256/13.1
6,398,192 B1 6/2002 Albritton
6,435,761 B1 8/2002 Bligh et al.
6,575,434 B2 6/2003 Bligh et al.
6,729,607 B2 5/2004 Alberson et al.
6,902,150 B2 6/2005 Alberson et al.
(Continued)

FOREIGN PATENT DOCUMENTS

EP 1382748 A2 1/2004
WO 94/29528 A1 12/1994
(Continued)

OTHER PUBLICATIONS

International Search Report and Written Opinion for PCT Patent Application No. PCT/US2019/056538, dated Jan. 16, 2020.
(Continued)

*Primary Examiner* — Gary S Hartmann
(74) *Attorney, Agent, or Firm* — Baker Botts L.L.P.

(57) ABSTRACT

A cable anchor deflector bracket includes a first portion and a second portion. The first portion is coupled to a guardrail at a location adjacent to a cable anchor bracket, which is an attachment point where a cable couples to the guardrail. The second portion slopes outwardly away from the guardrail and is proximate to an end of the cable anchor bracket and the end of the cable anchor assembly.

24 Claims, 7 Drawing Sheets

(56) References Cited

U.S. PATENT DOCUMENTS

| | | | | |
|---|---|---|---|---|
| 8,448,913 | B1 * | 5/2013 | Rohde | E01F 15/143 248/548 |
| 9,453,312 | B2 * | 9/2016 | James | E01F 15/143 |
| 9,689,124 | B2 * | 6/2017 | Harman | E01F 15/143 |
| 10,036,132 | B2 * | 7/2018 | Sicking | E01F 15/0423 |
| 2005/0077507 | A1 | 4/2005 | Heimbecker et al. | |

FOREIGN PATENT DOCUMENTS

| | | | |
|---|---|---|---|
| WO | 96/20311 | A2 | 7/1996 |
| WO | 00/66837 | A1 | 11/2000 |
| WO | 2016/033122 | A1 | 3/2016 |

OTHER PUBLICATIONS

PCT International Preliminary Report on Patentability issued for International application No. PCT/US2019/056538—dated Apr. 14, 2021.

* cited by examiner

DEFLECTOR BRACKET AND CABLE ANCHOR FOR GUARDRAIL TERMINAL

PRIORITY

This application claims priority to U.S. Patent Provisional Application No. 62/746,352 filed on Oct. 16, 2018, entitled "Deflector Bracket and Cable Anchor for Guardrail Terminal," the disclosure of which is hereby incorporated by reference.

TECHNICAL FIELD

The present invention relates generally to safety treatment for the ends of W-beam guardrails, and more particularly, to a deflector bracket and cable anchor for tensioned guardrail terminals for improving performance in a reverse direction impact by a vehicle.

BACKGROUND

Along most highways there are hazards that can be a substantial danger to drivers of automobiles if the automobiles leave the highway. To reduce the severity of accidents due to vehicles leaving a highway, guardrails are provided. Semi-rigid W-beam guardrails are usually positioned alongside vehicular traffic routes, especially highways, for the purposes of preventing vehicles from colliding with fixed objects, other vehicles, or driving off the roadway. To this end, the guardrails should have sufficient integrity to prevent an impacting vehicle approaching from an angle relatively oblique to the length of the rail from breaking or tearing through their structure and leaving the roadway. Thus, a guardrail is provided to aid in redirecting an obliquely impacting vehicle back onto the roadway while at the same time managing its impact force in a controlled manner.

Guardrails must be installed, however, such that the upstream end, or terminal end of the guardrail facing the flow of traffic is not, itself, a hazard. Early guardrails had no proper termination at the ends, and it was not uncommon for impacting vehicles to become impaled on the raised end of such a guardrail causing intense deceleration of the vehicle and severe injury to the occupants. In some reported cases, the upstream end of guardrail penetrated directly into the occupant compartment of the vehicle fatally injuring the occupants.

Upon recognition of the problem of proper guardrail termination, guardrail designs have been developed employing box beams and W-beams that allow sloping of the end of a guardrail into the ground. These designs provide a ramp and help to eliminate spearing effects. However, while these end treatments successfully reduced the danger of a vehicle being penetrated in a head-on collision, it has been discovered that they also tend to induce launching of the vehicle to the extent of becoming airborne for a considerable distance with the possibility of rollover.

A number of alternate designs have focused on reducing the dynamic buckling resistance of a raised end-type guardrail against substantially end-on impacts to reduce potential damage to impacting vehicles and injury severity to their occupants. While these end treatments help to reduce dangerous vaulting and roll over of vehicles, they do not provide a panacea.

Designs are also known in which sections of guardrail are curved away from the roadway to create an eccentric loading upon the sections during an end-on impact. The end piece of this design typically includes a customized nose piece which may consist of a fabricated structural steel lever nose surrounded by a vertical section of corrugated steel pipe. The lever nose is adapted to induce a moment near the upstream end of the guardrail sections upon an end-on impact, thereby facilitating desired buckling in the guardrail sections. These designs are also intended to facilitate "gating" of an impacting vehicle through the guardrail structure from the roadway side of the guardrail to the opposite side of the rail. However, they have proven costly. They are also rather complicated and in actual field installation require careful attention to installation details.

Another safety treatment consists of overlapped guardrail sections that have a series of closely spaced slots. The guardrail segments are attached by bolts extending through the slots. When a vehicle impacts the end of this barrier, the bolts are forced to tear through the guardrail sections from one slot to the next. As a result, the guardrail segments are cut into several long ribbons as an impacting vehicle is decelerated. This safety treatment appears too costly for wide spread implementation as a guardrail end treatment.

A further alternate end treatment is constructed from a series of breakaway steel guardrail posts and fragile plastic containers containing sandbags. Impacting vehicles are decelerated as the guardrail posts are broken and sand bags in the plastic containers are impacted. A cable is used to guide vehicles away from the guardrail during impact. This type system is very expensive, and has not gained wide acceptance.

Another development is a terminal in which longitudinal slots are cut into a section of a W-beam rail to reduce the rail's dynamic buckling strength during end-on impacts. The terminal is typically installed on a parabolic flare, or outwardly curving configuration, away from the roadway. Cover plates are used to shield the slots and prevent extension of the slots and tearing of the rail during oblique impacts. The cover plates are sections of W-beam guardrail placed directly over the slots and are bolted to at least one end of the slotted section of guardrail.

The design normally includes a groundline cable to facilitate fracture of support posts and help prevent bending and rotation of the posts prior to breaking. The groundline cable is anchored near ground level to the support post at the most downstream end of the terminal, and extends upstream through boreholes in intermediate posts and is then anchored to the most upstream post. During an end-on collision, the groundline cable prevents rotation of the posts while the hole in each post sufficiently weakens the posts allowing them to break off upon engagement with the impacting vehicle. Additional posts have been used with this design to aid in redirection of obliquely impacting vehicles.

Construction details such as the cover plates, groundline cable and additional posts complicate installation and maintenance and have hindered its acceptance in the highway community. The cover plates reduce the ability of the guardrail to buckle and collapse, thereby lessening the rate of energy attenuation. The presence of unreinforced slots to reduce the rail's dynamic buckling resistance to end-on impacts may also function to reduce the rail's integrity during oblique impacts. Heavy or fast obliquely impacting vehicles might actually tear through the rail rather than being redirected back into traffic by it. Additionally, when a vehicle impacts the terminal portion of the guardrail in the reverse direction components of the terminal such as posts may snag on the hardware attaching the cable to the guardrail beam, which may result in additional damage to the vehicle and danger to the occupants of the vehicle and others on the roadway.

It is desirable to provide a guardrail design, having particular application as an end treatment, which addresses the problem of the snagging on hardware during reverse impacts while providing sufficient integrity for the guardrail structure to reduce the problems associated with oblique and end-on impacts.

SUMMARY

To address the foregoing problems with existing solutions, disclosed is systems and methods for a deflector bracket and cable anchor for guardrail terminal.

According to certain embodiments, a terminal portion of a guardrail safety system includes a terminal portion of a guardrail and support posts installed adjacent a roadway in spaced apart relation to one another. The support posts include at least a terminal support post installed adjacent the roadway at an upstream end of the end terminal and at least one additional support post adjacent the roadway. The terminal support post is coupled to an upstream end of a terminal portion of the guardrail, and at least one additional support post is positioned downstream from the terminal support post. A cable includes a first end and a second end. The first end is coupled to the terminal support post at a location proximate the earth's surface. The second end of the cable is coupled to the guardrail via a cable anchor bracket at an attachment point between the terminal support post and the at least one additional support post. A cable anchor deflector bracket is coupled to the guardrail at a location that is downstream of and adjacent to the attachment point where the second end of the cable couples to the guardrail. The cable anchor deflector bracket includes a first portion that is coupled to the guardrail proximate the end of the cable anchor deflector bracket and a second portion that slopes outwardly away from the guardrail and is proximate to, abuts, or covers an end of the cable anchor bracket.

According to certain embodiments, a cable anchor deflector bracket includes a first portion and a second portion. The first portion is coupled to a guardrail at a location adjacent to a cable anchor bracket, which is an attachment point where a cable couples to the guardrail. The second portion slopes outwardly away from the guardrail and is proximate to, abuts, or covers an end of the cable anchor bracket.

Certain embodiments of the present disclosure may provide one or more technical advantages. For example, certain embodiments may provide a cable anchor deflector bracket that is configured to be positioned proximate to, abutting, and/or covering a cable anchor bracket or other mechanism for attaching a cable to a guardrail beam. As another example, certain embodiments may cover at least a portion of the cable anchor bracket to prevent the snagging of vehicles on the cable anchor bracket, cable end, and other hardware during reverse impacts.

Other advantages may be readily apparent to one having skill in the art. Certain embodiments may have none, some, or all of the recited advantages.

DETAILED DESCRIPTION

Particular embodiments are described in FIGS. 1-7 of the drawings, like numerals being used for like and corresponding parts of the various drawings. For clarity of illustration, the drawings and following discussion refer primarily to a slotted rail terminal generally adapted for use or terminating guardrail along roadways. The present invention can be adapted for use along roadways having different vehicular speeds by varying the number, location and length of slots in the W-beam and/or number of support posts. Additionally, while the drawings and discussion may refer to a slotted rail terminal, it is generally recognized that the rail terminal may include any type of rail terminal.

Figure 1A:
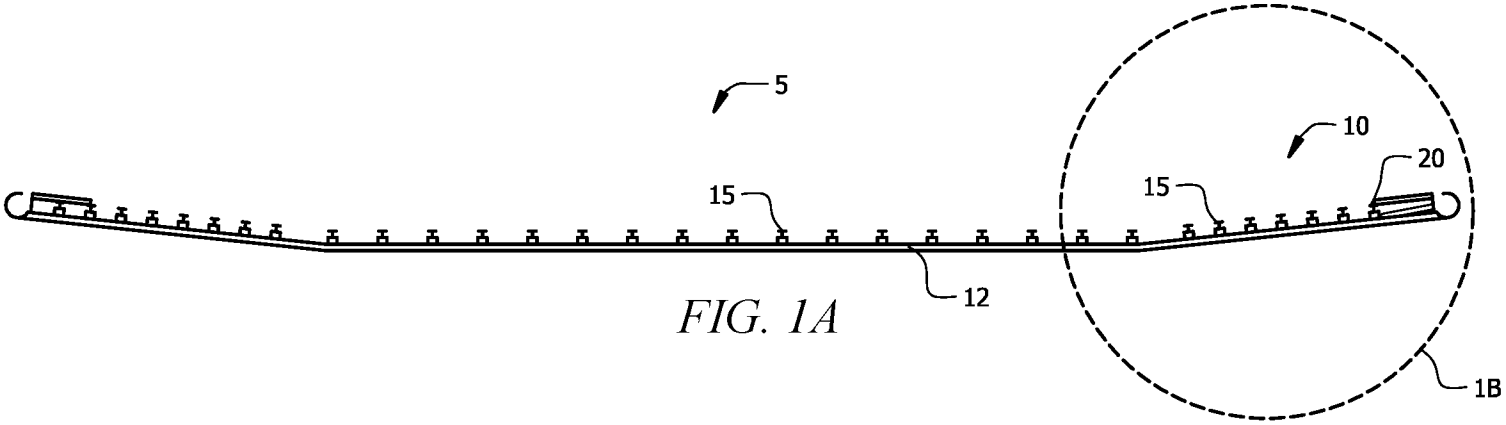
FIGS. 1A and 1B illustrate an example guardrail assembly that includes a guardrail terminal, according to certain embodiments.
Figure 1B:
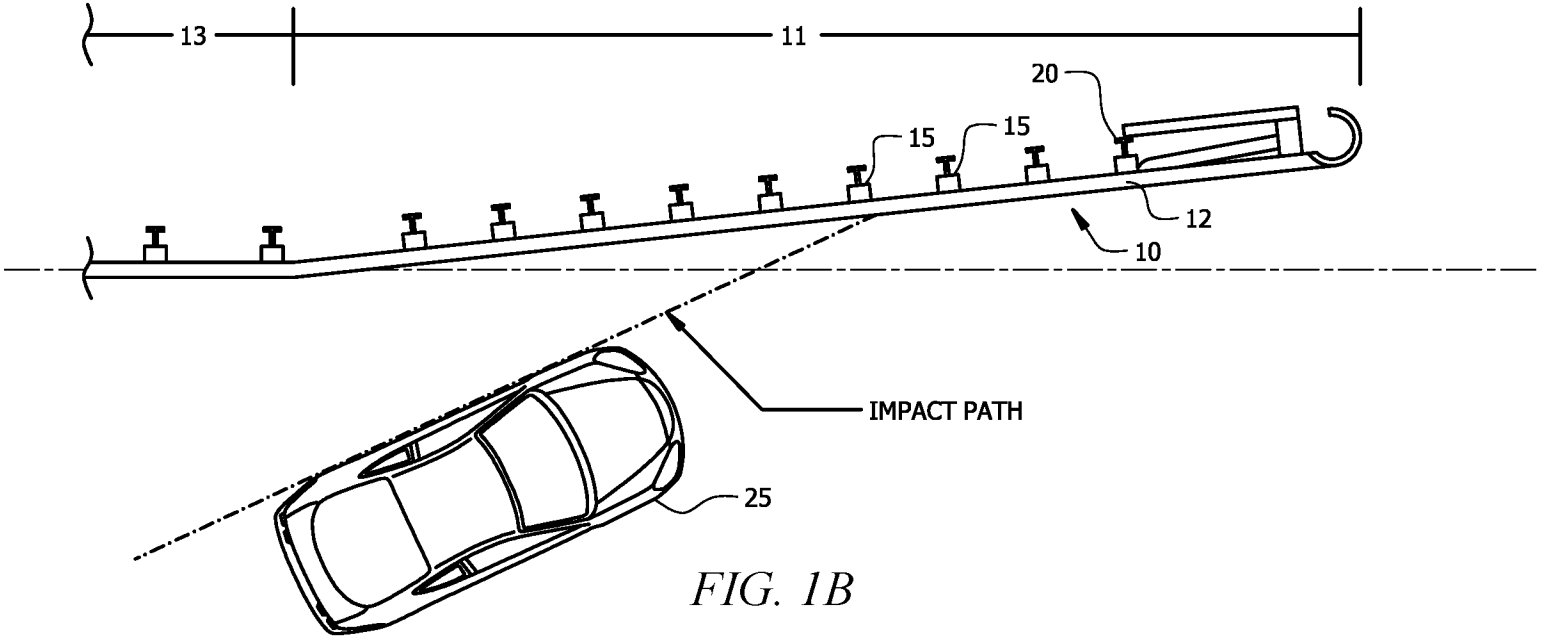

FIGS. 1A and 1B illustrate an example guardrail safety system 5 that includes a guardrail terminal 10, according to certain embodiments. As shown in FIGS. 1A and 1B, guardrail terminal 10 is employed as an end terminal for guardrail safety system 5. As shown in FIG. 1B, guardrail terminal 10 features an upstream portion 11 and a more downstream portion 13 with the upstream portion 11 disposed relative to the expected direction of traffic and longitudinally disposed loadings on the rail from end-on impacts Guardrail terminal 10 may include a section of corrugated guardrail 12 mounted on one or more support posts 15. In a particular embodiment, guardrail 12 may include multiple 12-gauge W-beam rail elements of a length on the order of approximately 12.5 feet or 25 feet. The guardrail beam sections may be mounted at a height of on the order of approximately 27 to 31 inches with rail splices positioned mid-span between the support posts 15.

According to certain embodiments, guardrail beam 12 may be attached to support posts 50 with connectors that may include, in particular embodiments, button-head guardrail bolts with oval shoulders or slotted countersunk bolts such as, for example, 16 mm (⅝-inch) diameter by 38 mm (1½-inch) long. Oversized guardrail nuts may be used on the back side of the support post. Support posts 50 may be embedded in the ground, a concrete footing, or a metal socket. Support posts 50 may be made of wood, metal, plastic, composite materials, or any combination of these or other suitable materials. It is also recognized that each support post 50 within guardrail system need not necessarily be made of the same material or include the same structural features. Furthermore, the cross-section of support posts may be any engineered shape suitable for releasably supporting guardrail 12. Such cross-sectional shapes may include, but are not limited to, square, rectangular, round, elliptical, trapezoidal, solid, hollow, closed, or open. An example support post 50 is described in more detail below with regard to FIGS. 2A-2C.

According to certain embodiments, posts 15 may include posts that breakaway, yield, or release upon impact by a vehicle 25. For example, posts 15 may comprise 6"×8" rectangular wooden posts embedded in concrete in the soil or ground. In an alternative embodiment, the posts 15 may be placed into vertically positioned steel foundation tubes of a type generally known in the art. Posts 15 can alternatively be comprised of metal posts that have a designed weakening or release mechanism. At a more downstream point, the terminal may be supported by conventional support posts of more substantial wood, metal or other material, in a particular embodiment. The guardrail 12 may be affixed to the posts 15 by fasteners such as bolts.

According to certain embodiments, guardrail assembly 5 may be installed either parallel to the roadway or at an angular departure from the roadway, as shown best in FIG. 1A. As depicted each terminal section of the guardrail safety system is flared, while a middle section of guardrail safety system 5 is not flared. For example, in the embodiment depicted in FIG. 1A, an upstream section of guardrail terminal 10 is flared while a downstream section of guardrail terminal 10 is not flared. Specifically, the upstream section of guardrail terminal 10 is flared away from the roadway in a substantially linear manner while the downstream section of guardrail terminal 10 remains substantially parallel to the roadway. In other embodiments, both sections of guardrail terminal 10 may be flared or unflared in a similar manner. Additionally, it is recognized that other configurations may be used for the sections of guardrail terminal 10. For example, one or both of the sections of guardrail terminal 10 may be installed at a parabolic flare away from the roadway. A parabolic flare may be accomplished by increasing the offset of each support post in a generally parabolic progression as the terminal portion proceeds upstream. Where incorporated, positioning of one or more of the sections of guardrail terminal 10 at a flared or angular departure away from the roadway may permit the sections of guardrail terminal 10 to perform a gating function by facilitating movement of the impacting vehicle 25 to the side of the rail opposite the roadway as the vehicle 25 progresses.

In a particular embodiment where a section of guardrail terminal 10 is linearly flared, the section may be flared back at an angle of approximately 6 to 7 degrees from the non-terminal portion of the guardrail. The spacing of the support posts of guardrail terminal 10 can vary to accommodate different impact conditions. In particular embodiments, the support posts of guardrail terminal 10 can be spaced apart at intervals of approximately 37.5 inches, 42 inches, 75 inches, or combinations thereof, with each support post having a prescribed offset from a line tangent to the non-terminal portion of the guardrail.

Although FIGS. 1A and 1B are illustrated with dimensions and depicts one exemplary embodiment, it is understood that the dimensions of guardrail system may vary depending on the nature of the roadside hazard being shielded.

Figure 2A:
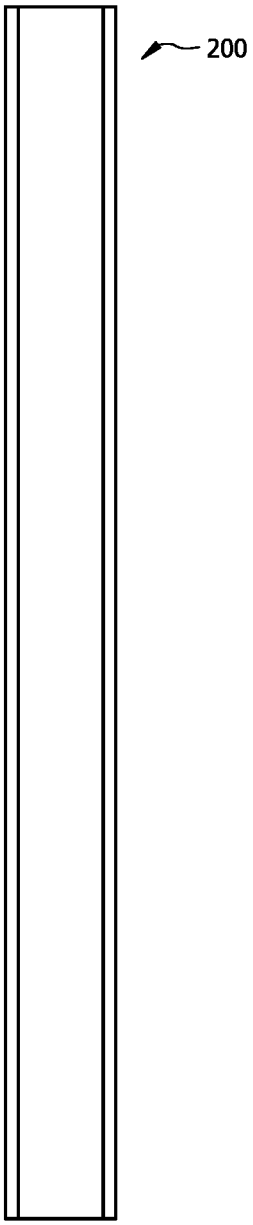
FIGS. 2A-2C illustrate an example embodiment of a support post 200 that may be used in conjunction with guardrail safety system 5 of FIGS. 1A and 1B, according to certain embodiments.
Figure 2B:
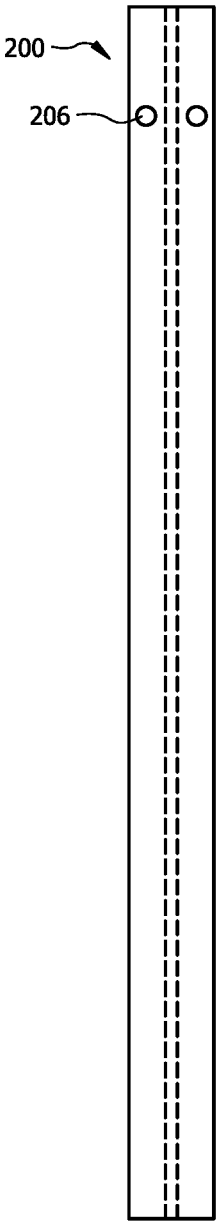
Figure 2C:
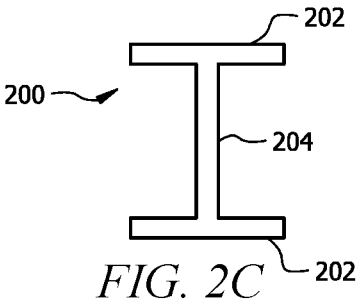

FIGS. 2A-2C illustrate an example embodiment of a support post 200 that may be used in conjunction with guardrail assembly 5 of FIGS. 1A and 1B, according to certain embodiments.

As illustrated, support posts 200 include elongate, continuous structural members and are each of a standard wide flange configuration. Each support post includes two flanges 202 that are generally parallel with one another, and in spaced apart relation from one another. A web 204 forms the coupling between flanges 202. In a particular embodiment, flanges 202 include a generally identical configuration of bolt holes 206, therein.

With regard to the wide flange shape used as a guardrail post 200, the cross section is typically shaped like the letter "H". The cross section has two major axes for bending. The "weak" axis generally refers to a central axis that extends through the web and is perpendicular to the flanges. The "strong" axis generally refers to a central axis that is perpendicular to the web and parallel to the planes of the flanges. The weak axis for a conventional installation of guardrail extends generally transversely to the road. The strong axis extends generally along the roadway.

In a particular embodiment, support post 200 may include a wide flange such as, for example, a standard W6×8.5, which is commonly used in fabricating support posts for guardrail installations. A standard W6×8.5 wide flange may have a nominal six-inch depth and weigh eight and one-half pounds per foot. Those of ordinary skill in the art will recognize that wide flange beams may be available in many different sizes. For example, a wide flange having a six-inch depth and weighing nine pounds per foot may also be used. Such a wide flange is referred to as a W6×9 wide flange. However, a W6×9 wide flange and a W6×8.5 wide flange are considered equivalent in the trade. The terms "W6×8.5 wide flange" and "W6×9 wide flange" are intended to refer to all sizes and configurations of guardrail posts that may be referred to as "W6×9" by a person of ordinary skill in the art. In addition, persons skilled in the art recognize other names used for wide flanges include but are not limited to "I-beam," "H-beam," "W-beam," "S-beam," "M-beam," or the term "shape" may be substituted for "beam."

According to a particular embodiment, support post 200 may have a length in a range of approximately 72 and 73⅜ inches and include an upper portion and a lower portion. A mid portion couples upper portion with lower portion. The upper portion includes two bolt holes 206 that are adapted to receive connectors for the installation of a guardrail beam (e.g., guardrail 12) upon the support post. A lower portion may be suitable for installation below grade, as part of a guardrail support system.

Bolt holes 206 include a standard configuration that allow for the installation of widely used guardrail beams, upon the respective support post. In general, bolt holes 206 align with the center of the guardrail beam, and maintain the center of the guardrail beam a prescribed distance above grade. In particular embodiments, the center of the guardrail beam may be mounted at a height of 21 inches to 25 inches. However, the number, size, location and configuration of bolt holes 206 may be significantly modified within the teachings of the present disclosure.

According to certain embodiments, support post 200 may be modified to include a relatively "weak" axis W, and a relatively "strong" axis S. Support posts 200 are normally installed along a roadway such that weak axis W is generally perpendicular to the direction of traffic, and strong axis S is generally parallel to the direction of traffic. Accordingly, support post 200 may typically be able to withstand a significant impact (e.g., with a car traveling at a high rate of speed) about the strong axis S without substantial failure. However, support post 200 is intentionally designed such that strength about the weak axis W is less to accommodate end-on impacts of the terminal. Stated differently, support post 200 exhibits adequate strength in the lateral direction but sufficiently low strength in the longitudinal direction. Accordingly, if a vehicle 25 impacts guardrail terminal 10 "end-on", support post 200 will tend to yield (e.g., buckle, bend), while allowing the vehicle 25 to decelerate as it impacts consecutive support posts. However, if a vehicle 25 strikes guardrail terminal 10 along the face of and at an angle to guardrail 12, support post 200 will provide sufficient resistance (strength) to redirect the vehicle 25 along a path generally parallel with guardrail 12.

Though not depicted, a mid portion of support post 200 may include cutouts, which are configured to further weaken the support posts about the weak axis W, to more readily allow for yielding due to impact from a vehicle 25 along that direction. Cutouts may be positioned within a mid portion to weaken the support posts about weak axis W, adjacent grade (when installed). This will accommodate yielding of the support posts approximately at grade, allowing support post 200 to "fold" over from the point of bending, upward.

It will be recognized by those of ordinary skill in the art that the size, configuration, location and number of bolt holes, cutouts, and their relationship with each other, may be varied significantly within the teachings of the present invention. The overall length of the support posts, and their respective upper, lower and mid portions may vary significantly, within the teachings of the present invention. For example, in other embodiments, the cutouts may occur below grade or above grade. The depth of the cutouts below grade should not exceed an amount that will prevent the support posts from yielding and bending at or near the location of the cutouts. Similarly, the height of the cutouts above grade should not exceed a point at which the support post will yield and bend at the cutouts.

Referring again to FIGS. 1A and 1B, in operation, the guardrail terminal 10 is typically positioned along a highway to prevent obliquely impacting vehicle 25 from encroaching into the area shielded by the guardrail. It is intended that vehicle 25 will impact the guardrail terminal 10 downstream of its upstream portion 11 and on the side of the terminal 10 facing the roadway.

As described above, the terminal may be installed either parallel to the roadway or in an angular departure from the roadway to reduce likelihood of impact and enhance the "gating" features of the terminal. In a particular embodiment, the guardrail terminal 10 of the present invention is installed with its upstream portion 11 at a parabolic flare away from the roadway. The parabolic flare is accomplished by increasing the offset of each support post in a generally parabolic progression as the terminal 10 proceeds upstream. The upstream portion 11 may also be flared away from the roadway using other configurations such as a linear or straight flare wherein the angled-away portion of rail is relatively straight rather than curved. Positioning of the upstream end of the terminal in an angular departure away from the roadway permits the end to be readily buckled and bent away from the roadway during an end-on impact. This "gating" of the end facilitates movement of the impacting vehicle 25 to the side of the rail opposite the roadway as the vehicle 25 progresses.

According to certain embodiments, a breakaway cable arrangement may be used to improve the tensile strength and anchorage capacity of terminal 10. Suitable breakaway cable arrangements are described in Part No. F-37-76 in "a guide to standardized highway barrier rail hardware," ARTBA Bulletin No. 268-B, American Road and Transportation Assoc., Washington, D.C. 1979. As used herein, a breakaway cable arrangement may also be referred to as a tension cable assembly.

Figure 3:
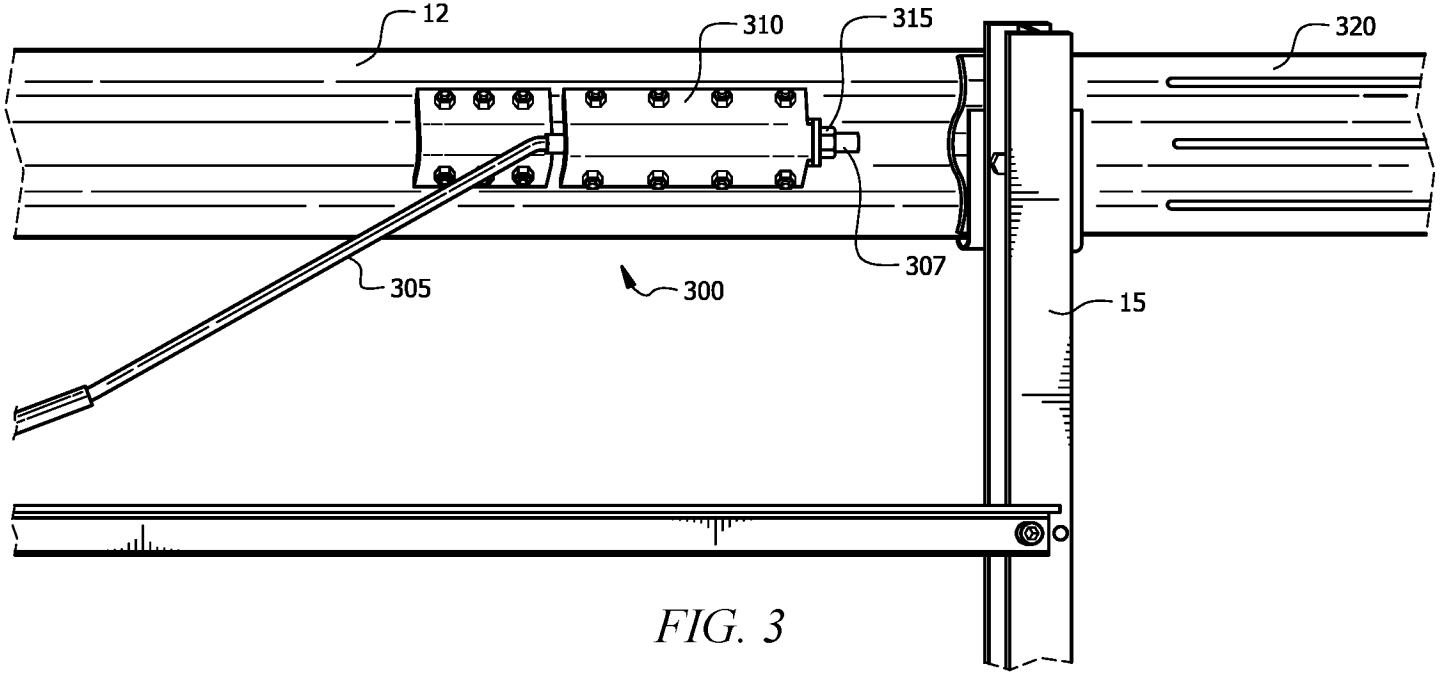
FIG. 3 illustrates a breakaway cable arrangement for coupling a breakaway cable to a terminal portion of a guardrail beam and a terminal support post, according to certain embodiments.

FIG. 3 illustrates a tension cable assembly 300 for coupling a cable 305 to a terminal portion of a guardrail beam 12 and a terminal support post 20, according to certain embodiments. Tension cable assembly 300 is used to help anchor the upstream end of the terminal 10.

According to certain embodiments, tension cable assembly 300 includes a cable 305 that has a first end (not shown) and a second end 307. At the first end, cable 305 is releasably secured to a cable release anchor or post at a location proximate the earth's surface such that when the cable release anchor or post is struck by vehicle 25 shown in FIG. 1B, cable 305 will be released from the cable release anchor or post. In a preferred embodiment, the first end (not shown) of cable 305 is provided with a threaded, lower distal end that is fitted with a nut. The cable release anchor provides positive anchorage to react to tensile loads on the guardrail 12 to redirect a vehicle 25 impacting obliquely along the length of the guardrail 12.

An example of the structure and operation of a cable release anchor may be more fully appreciated by reference to U.S. Pat. No. 6,729,607, which the entirety thereof is incorporated herein by reference. As disclosed therein, the cable release anchor may secure one end of the tension cable 305. The anchor may also be used as an upstream support for the guardrail 12, although the support of such a rail member is not necessary.

According to certain embodiments, second end 307 of cable 305 is coupled to guardrail 12 at an attachment point. For example, as depicted in FIG. 3, second end 307 of cable 305 is coupled to guardrail 12 using a cable anchor bracket 310. Specifically, the end of cable 305 is threaded through the cable anchor bracket 310 and is held in place by a threaded nut 315.

Though it is recognized that guardrail 12 may include any suitable type of guardrail beam, FIG. 3 illustrates guardrail 12 as including a series of multiple slotted zones 320 longitudinally spaced along the guardrail 12. In a particular embodiment, each slotted zone 320 may be approximately centered or placed at quarter-distance points between the support posts. In a particular embodiment, the slotted zone 320 may include one or more slots longitudinally disposed in the guardrail 12. The use of three slots has proven effective in testing models of guardrails constructed similar to terminal 10.

In a particular embodiment, where a guardrail 12 is comprised of a W-beam that includes one or more valleys positioned between upper and lower peaks, slots 320 may be disposed proximate each peak and the valley. The slots 320 may be of a size sufficient to reduce the ability of the rail to resist buckling in response to a longitudinal loading from one end of the rail. Effective sizes for slots have been found to be approximately ½" in width and a minimum of 12" in length.

While guardrail 12 may include W-beam rail elements, it is generally recognized that the illustrated guardrail beam 12 is merely one example of a beam that may be used in a guardrail system. Guardrail beams 12 or portions of guardrail beams 12 may include conventional W-beam guardrails, thrie beam guardrails, box beams, wire ropes, or other structural members suitable for redirecting an errant vehicle upon impact. It is also recognized that the configuration and dimensions of any of the above-described elements within the guardrail system may vary as desired.

The example guardrail system described herein is intended to keep errant vehicles from encountering more severe hazards on the roadside. Tests are conducted to assess the performance of the guardrail system under different impact conditions. For example, the second edition of the AASHTO Manual for Assessing Safety Hardware (MASH 2016) contains a matrix of several tests used to evaluate guardrail end terminals. One of these test is Test 37, which involves an impact from the reverse direction. This test is recommended when a terminal system is placed within the clear zone of opposing traffic. MASH 2016 indicates that "For post-and-beam terminals utilizing a breakaway cable system, the 1100 C will generally be the critical vehicle for this test, and the impact point should be selected to maximize the risk of the vehicle snagging on the anchor cable."

MASH 2016 Test 3-37b was performed on the Slotted Rail Terminal (SRT) to evaluate the new MASH 2016 criteria. This test involved an 1100 C passenger car impacting the terminal in the reverse direction at a speed of 62 mph and an angle of 25 degrees. During the test, the test vehicle contacted a support post such as support post 15 depicted in FIG. 3 and pushed it forward longitudinally. The upper section of support post 15 contacted second end 307 of cable 305 on the end of the anchor cable assembly 300 that protrudes from the end of cable anchor bracket 310. This contact restricted further forward movement of support post 15 and generated increased snagging forces on the vehicle wheel assembly. The snagging forces induced a yaw velocity in the vehicle that ultimately resulted in rollover of the vehicle as it exited the system.

Figure 4:
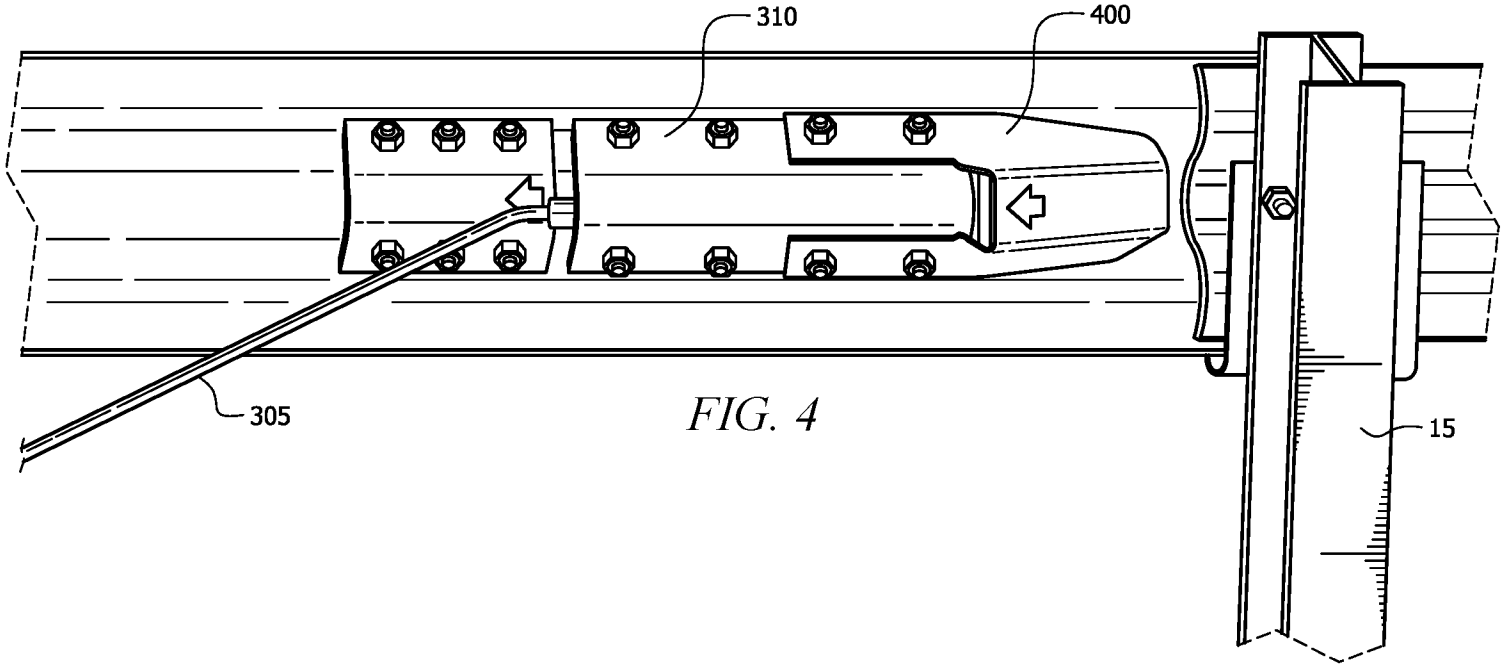
FIG. 4 illustrates an example cable anchor deflector bracket, according to certain embodiments.

To address these concerns, an improvement to the previously described guardrail systems will now be described with regard to FIG. 4. Specifically, FIG. 4 illustrates an example cable anchor deflector bracket 400, according to certain embodiments. Cable anchor deflector bracket 400 may eliminate or substantially decrease the contact between support post 15 (depicted in FIG. 3) and the end 307 of cable 305 and cable anchor bracket 310. As illustrated, cable anchor deflector bracket 400 consists of a tapered steel plate that is positioned on the back of a guardrail 12 immediately downstream of a cable anchor bracket 310.

Figure 5:
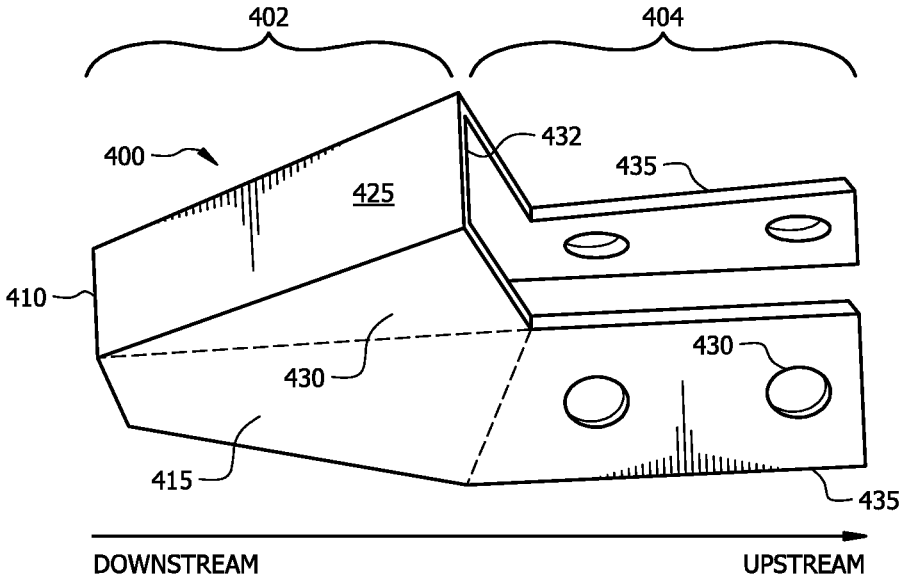
FIG. 5 illustrates the example cable anchor deflector bracket in more detail, according to certain embodiments.

FIG. 5 illustrates an example cable anchor deflector bracket 400 in more detail, according to certain embodiments. As depicted, cable anchor deflector bracket 400 comprises a central portion 402 on the downstream end and wing portion 404 on the upstream end of the cable anchor deflector bracket 400. Wing portion 404 extends at an angle from the central portion 402 so that the configuration of the central portion 402 and wing portion 404 permits the cable anchor deflector bracket 400 to be coupled to the guardrail 12 proximate to an end of cable anchor deflector bracket 400.

According to certain particular embodiments wherein the guardrail beam is a W-beam, the shape of the downstream end of the cable anchor deflector bracket 400 may generally conform to the middle or the valley of the guardrail 12. The downstream end of the cable anchor deflector bracket 400 has a flat edge 430 that may be positioned perpendicular to the longitudinal axis of the W-beam rail and two flared sides 415 that may match the shape of the W-beam. Front panel 425 of the cable anchor deflector bracket 400 slopes outwardly away from the back of the W-beam and transitions to rectangular shape 432 that closely matches the raised end of the cable anchor bracket 310. In this manner, the cable anchor deflector bracket 400 covers the exposed end of the cable anchor assembly that protrudes beyond the downstream end of the cable anchor bracket.

In the depicted example embodiment of FIGS. 4 and 5, two wings 435 in wing portion 404 on the cable anchor deflector bracket 400 extend further upstream and overlap the flared sides of the cable anchor bracket 310. The cable anchor deflector bracket 400 is secured to the outside of the cable anchor bracket 310 using four existing anchor bracket attachment bolts (two on each side through the slots 430 in wings 435 of the cable anchor deflector bracket), in a particular embodiment.

In operation, when support post 15 as depicted in FIG. 3 is contacted by a vehicle such as vehicle 25 in FIG. 1B and pushed longitudinally toward an adjacent support post 15 during a reverse direction impact, support post 15 will contact the cable anchor deflector bracket 400 and be pushed outward and away from the cable anchor bracket 310 rather than snag on the end of the cable anchor bracket 310 and/or the second end 307 of cable 305. When Test 3-37b was repeated with the cable anchor deflector bracket 400 attached to the guardrail terminal, the cable anchor deflector bracket 400 performed as designed.

Figure 6:
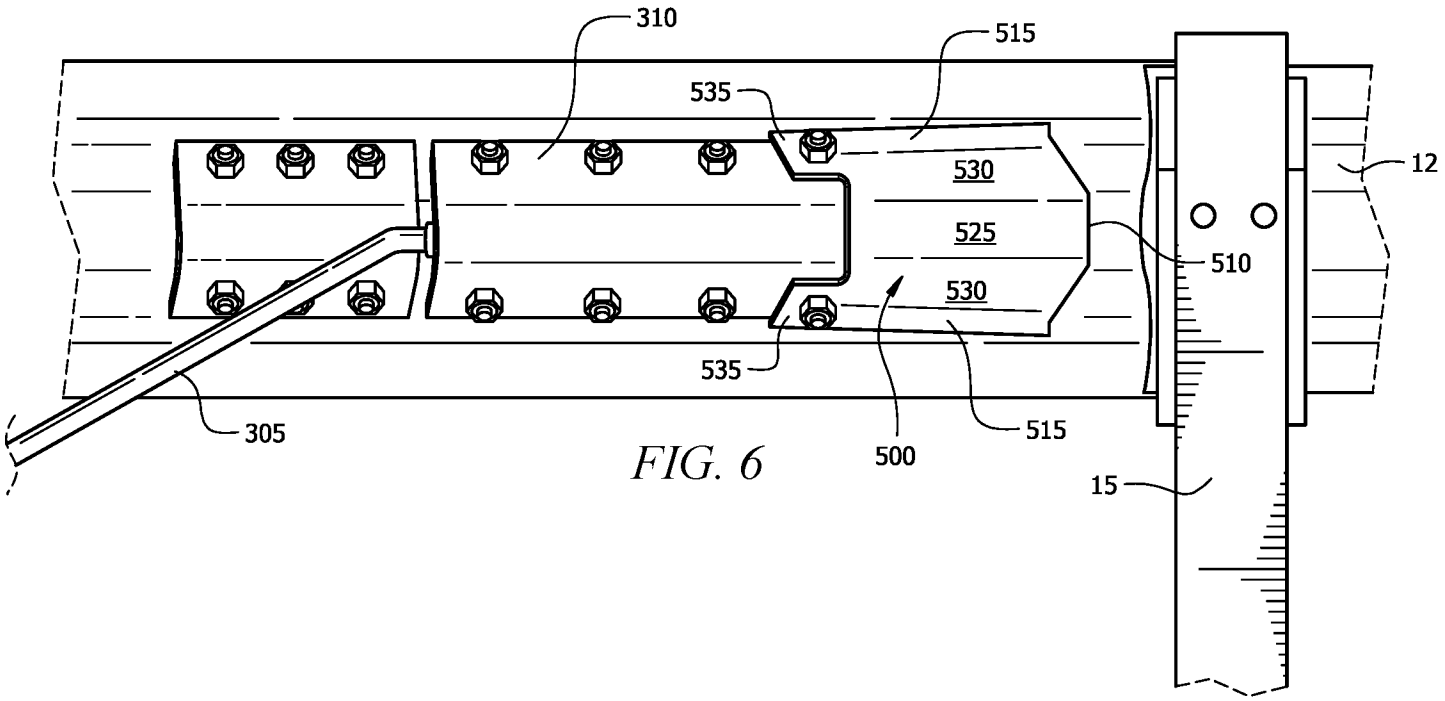
FIG. 6 illustrates another example cable anchor deflector bracket, according to certain embodiments.

FIG. 6 illustrates another example cable anchor deflector bracket 500, according to certain embodiments. In the illustrated embodiment, the cable anchor deflector bracket 500 includes many of the features depicted and described above with regard cable anchor bracket 400 of FIGS. 4 and 5. Similar features may not be described in detail with regard to FIG. 6.

As depicted, cable anchor deflector bracket 500 differs from cable anchor deflector bracket 400 in that the wing portion extending at an angle from the central portion is shorter than the wing portion 404 depicted in FIGS. 4 and 5. Rather, here, the cable anchor deflector bracket 500 is secured to the outside of the cable anchor bracket 310 using only two existing anchor bracket attachment bolts (one on each side through the slots in wings 535 of the cable anchor deflector bracket 500), in a particular embodiment.

Similar to cable anchor deflector bracket 400, the shape of the downstream end of the cable anchor deflector bracket 500 generally conforms to the middle or the valley of the guardrail 12, where guardrail beam 12 is a W-beam. The downstream end of the cable anchor deflector bracket 500 has a flat edge 530 that is positioned perpendicular to the longitudinal axis of the guardrail 12 and two flared sides 515 that match the shape of the W-beam. Front panel 525 of the cable anchor deflector bracket 500 slopes outwardly away from the back of the W-beam and transitions to rectangular shape 532 that closes matches the raised end of the cable anchor bracket. In this manner, the cable anchor deflector bracket 500 covers the exposed end of the cable anchor assembly that protrudes beyond the downstream end of the cable anchor bracket.

Figure 7:
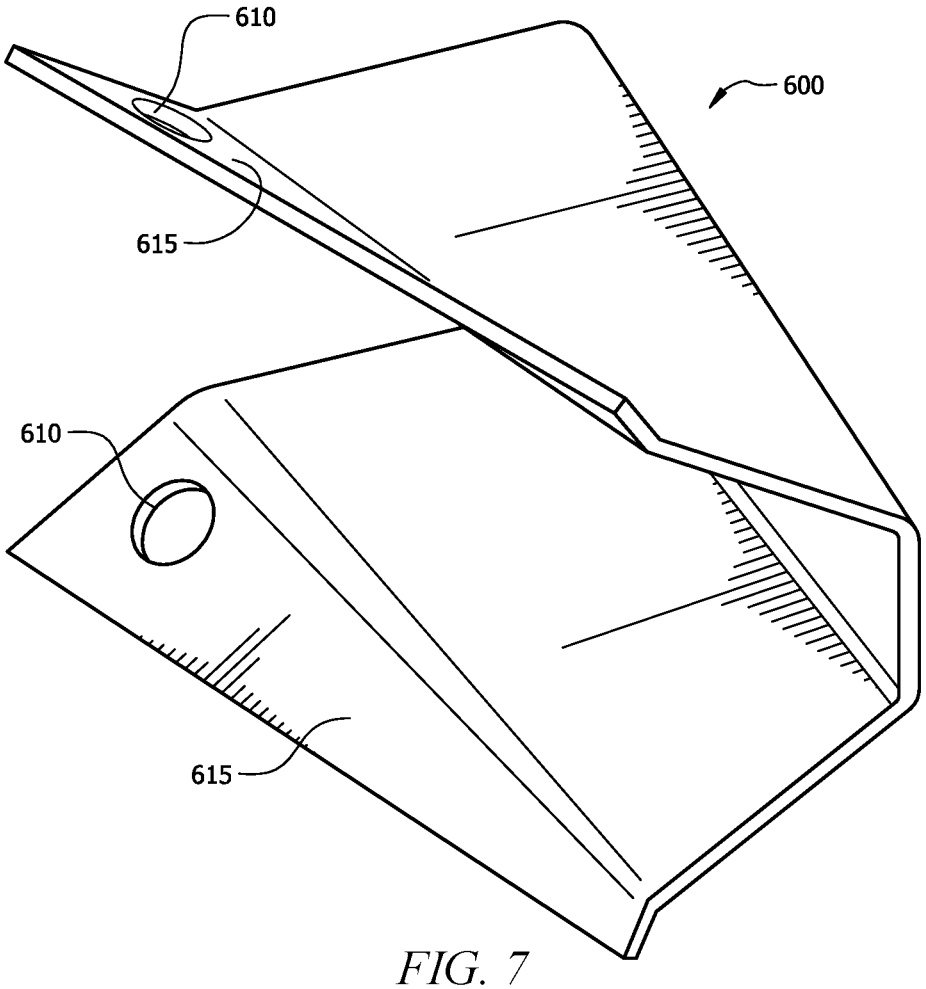
FIG. 7 illustrates another example cable anchor deflector bracket, according to certain embodiments.

FIG. 7 illustrates another example cable anchor deflector bracket 600, according to certain embodiments. In the illustrated embodiment, the cable anchor deflector bracket 500 includes many of the features depicted and described above with regard cable anchor bracket 400 of FIGS. 4 and 5. Similar features may not be described in detail.

As depicted, cable anchor deflector bracket 600 differs from cable anchor deflector bracket 400 in that it does not include wings 435 extending at an angle from a central portion 402. Rather, one or more bolt holes 610 formed in flared sides 615 permit the cable anchor deflector bracket 600 to be coupled to the guardrail 12 proximate to an end of cable anchor bracket 310.

While the techniques and embodiments disclosed herein are susceptible to various modifications and alternative forms, specific embodiments have been shown by way of example in the drawings and have been described in detail. However, it should be understood that the invention is not intended to be limited to the particular forms disclosed. For example, rather than a W-beam, the rail used with the terminal may have a different cross-sectional configuration. Other modifications and alterations will be apparent to those skilled in the art. The invention is intended to cover all modifications, equivalents and alternatives following within the spirit and scope of the invention as defined by the appended claims.

The invention claimed is:

1. A terminal portion of a guardrail safety system comprising:

a terminal portion of a guardrail;

a plurality of support posts installed adjacent a roadway in spaced apart relation to one another, the plurality of support posts comprising at least:

a terminal support post installed adjacent the roadway at an upstream end of the terminal portion of the guardrail safety system, the terminal support post coupled to an upstream end of a terminal portion of the guardrail; and at least one additional support post adjacent the roadway, the at least one additional support post positioned downstream from the terminal support post;

a cable comprising a first end and a second end, the first end of the cable coupled to the terminal support post at a location proximate a post supporting substrate, the second end of the cable coupled to the guardrail via a cable anchor bracket at an attachment point between the terminal support post and the at least one additional support post; and a cable anchor deflector bracket configured to couple to the guardrail and slope outwardly away from the guardrail, the cable anchor deflector bracket being proximate to a downstream end of the cable anchor bracket, wherein the cable anchor deflector bracket covers an exposed end of the cable that protrudes beyond the downstream end of the cable anchor bracket.

2. The terminal portion of claim 1, wherein the cable anchor deflector bracket comprises:

a first portion that is coupled to the guardrail proximate an upstream end of the cable anchor deflector bracket; and a second portion that slopes outwardly away from the guardrail and is proximate to the downstream end of the cable anchor bracket.

3. The terminal portion of claim 2, wherein the second portion that slopes outwardly from the guardrail covers the downstream end of the cable anchor bracket.

4. The terminal portion of claim 2, wherein the first portion and the second portion of the cable anchor deflector bracket are portions of a central portion.

5. The terminal portion of any one of claim 1, wherein the first portion further comprises:

a first wing extending to an upstream end of the cable anchor deflector bracket, and a second wing extending to the upstream end of the cable anchor deflector bracket.

6. The terminal portion of claim 5, wherein each of the first and second wings extend at an angle from the second portion so that the configuration of first wing and the second wing permits the first portion of the cable anchor deflector bracket to be positioned proximate the end of cable anchor deflector bracket.

7. The terminal portion of claim 1, wherein the guardrail is a W-beam and the first portion of the cable anchor deflector bracket conforms to a valley portion of the guardrail.

8. The terminal portion of claim 1, wherein the first portion of the cable anchor deflector bracket comprises:

a flat edge that is positioned perpendicular to a longitudinal axis of the guardrail; and two flared sides that match the shape of the guardrail.

9. The terminal portion of claim 1, wherein the cable anchor deflector bracket comprises a front panel that slopes outwardly away from the back of the guardrail and transitions to a shape that substantially matches a raised end of the cable anchor bracket.

10. The terminal portion of claim 1, wherein the cable is configured to:

provide a resistive, tensile coupling that maintains tension in the terminal portion of the guardrail during an end-on or re-directive impact by a vehicle, and release the resistive, tensile coupling between the terminal support post and the guardrail during a reverse-direction impact.

11. The terminal portion of claim 1, wherein the terminal portion of the guardrail is substantially parallel to the roadway.

12. The terminal portion of claim 1, wherein the terminal portion of the guardrail is flared away from the roadway at an upstream end of the guardrail.

13. The terminal portion of claim 12, wherein the flare is substantially parabolic.

14. The terminal portion of claim 12, wherein the flare is substantially linear.

15. The terminal portion of claim 1, wherein the cable anchor deflector bracket is coupled to the guardrail at a location that is at least partially upstream of the second end of the cable.

16. A cable anchor deflector bracket comprising:

a first portion that is coupled to a guardrail at a location adjacent to a cable anchor bracket that comprises an attachment point where a cable couples to the guardrail; and a second portion that slopes outwardly away from the guardrail and is proximate to a downstream end of the cable anchor bracket, and wherein the cable anchor deflector bracket covers an exposed end of the cable that protrudes beyond the downstream end of the cable anchor bracket.

17. The cable anchor deflector bracket of claim 16, wherein the second portion that slopes outwardly from the guardrail covers the downstream end of the cable anchor bracket.

18. The cable anchor deflector bracket of claim 17, wherein the first portion and the second portion of the cable anchor deflector bracket.

19. The cable anchor deflector bracket of claim 16, wherein the first portion comprises:

a first wing extending to an upstream end of the cable anchor deflector bracket, and a second wing extending to the upstream end of the cable anchor deflector bracket.

20. The cable anchor deflector bracket of claim 19, wherein each of the first and second wings extend at an angle from the second portion so that the configuration of first wing and the second wing permits the first portion of the cable anchor deflector bracket to be positioned proximate an end of cable anchor deflector bracket.

21. The cable anchor deflector bracket of claim 16, wherein the guardrail is a W-beam and the first portion of the cable anchor deflector bracket conforms to a valley portion of the guardrail.

22. The cable anchor deflector bracket of claim 16, wherein the second portion of the cable anchor deflector bracket comprises:

a flat edge that is positioned perpendicular to a longitudinal axis of the guardrail; and two flared sides that match the shape of the guardrail.

23. The cable anchor deflector bracket of claim 16, wherein the second portion of the cable anchor deflector comprises a front panel that slopes outwardly away from the back of the guardrail and transitions to a shape that substantially matches a raised end of the cable anchor bracket.

24. The cable anchor deflector bracket of claim 16, wherein the location that the cable first portion is coupled to the guardrail is at least partially upstream of the exposed end of the cable.

* * * * *